US009702249B2

(12) United States Patent
Gordon et al.

(10) Patent No.: US 9,702,249 B2
(45) Date of Patent: Jul. 11, 2017

(54) WELL TESTING AND PRODUCTION APPARATUS AND METHOD

(75) Inventors: Alexandre Gordon, Aberdeen (GB); Graham Hall, Stonehaven (GB); John Reid, Perthshire (GB); Ian Donald, Aberdeen (GB)

(73) Assignee: OneSubsea IP UK Limited, London (GB)

( * ) Notice: Subject to any disclaimer, the term of this patent is extended or adjusted under 35 U.S.C. 154(b) by 882 days.

(21) Appl. No.: 13/881,357

(22) PCT Filed: Feb. 9, 2012 (Under 37 CFR 1.47)

(86) PCT No.: PCT/GB2012/000136
§ 371 (c)(1), (2), (4) Date: Feb. 27, 2015

(87) PCT Pub. No.: WO2012/107727
PCT Pub. Date: Aug. 16, 2012

(65) Prior Publication Data
US 2015/0184511 A1 Jul. 2, 2015

(30) Foreign Application Priority Data
Feb. 9, 2011 (GB) ..... 1102252.2

(51) Int. Cl.
*E21B 49/00* (2006.01)
*E21B 49/08* (2006.01)
*E21B 47/10* (2012.01)

(52) U.S. Cl.
CPC ..... *E21B 49/088* (2013.01); *E21B 47/10* (2013.01); *E21B 49/086* (2013.01)

(58) Field of Classification Search
CPC ..... E21B 47/10; E21B 49/088; E21B 49/086
USPC ..... 73/152.18, 152.23
See application file for complete search history.

(56) References Cited

U.S. PATENT DOCUMENTS 5,113,941 A * 5/1992 Donovan ..... E21B 43/12 166/113
5,971,077 A * 10/1999 Lilley ..... E21B 33/035 166/348
6,435,279 B1 * 8/2002 Howe et al. ..... E21B 49/086 166/336
7,458,257 B2 * 12/2008 Pop et al. ..... E21B 49/005 73/152.04
2010/0059221 A1 * 3/2010 Vannuffelen et al. .. E21B 41/04 166/264

FOREIGN PATENT DOCUMENTS

GB WO 2005047646 A1 * 5/2005 ..... E21B 33/03

* cited by examiner

*Primary Examiner* — Lisa Caputo
*Assistant Examiner* — Roger Hernandez-Prewitt
(74) *Attorney, Agent, or Firm* — Conley Rose, P.C.

(57) ABSTRACT

A well testing device for conducting well test operations on an oil, gas, or water well including a production flowline. A conduit guides fluids from the production flowline to the well test device and then back to the flowline. The well test device may include, in various combinations, one or more of a flow measurement device, a sampling device, a sampling chamber to collect sampled fluids from the production flowline, a particle separator, a particle detector, a pressure sensor, a temperature sensor, a controller or data storage module, a choke, and other components.

20 Claims, 7 Drawing Sheets

WELL TESTING AND PRODUCTION APPARATUS AND METHOD

This application is the U.S. National Stage under 35 U.S.C. §371 of International Patent Application No. PCT/GB2012/000136 filed Feb. 9, 2012, which claims the benefit of Great Britain Patent Application No. GB1102252.2 filed Feb. 9, 2011, entitled "Well Testing and Production Apparatus and Method."

BACKGROUND

The present disclosure relates to apparatus and methods for testing, sampling and/or recovering fluids from a well and/or injecting fluids into a well. Embodiments of the disclosure can be used for fluid testing during recovery and injection of fluids, as well as sampling of the fluids. Some embodiments relate especially but not exclusively to recovery and injection, into either the same, or a different well.

Once a well has been drilled it is "completed" by the installation of casing, valves and conduits to control the flow of the production fluids from the well and convey them to the surface for recovery in the production phase. After completion but before the production phase commences, the well must be tested to determine the quantity and quality of the production fluids flowing from the well. In particular, the well is tested to ensure that no obstructions remain to the flow of fluids from the well, which may have been present during the earlier procedures and provided inaccurate test results. During well test procedures, prior to the production phase, the production fluids are flowed from the reservoir through the casing and the wellhead and christmas tree and into a production flowline that connects the christmas tree to the surface. During initial phases of well testing the production fluids wash out the dense completion fluids used to control wellbore pressure during the completion phases of the well construction, and much of the debris and sand is also washed out of the well at this phase. The early production fluids are often mixed-phase fluids with a mixture of gasses, liquids and solids. They will often have a high gas content, which must be flared off at the surface. The maximum flow rate of the production fluids from the well during well testing is largely determined by the gas content, because flaring is highly exothermic and it is only possible to flare off gasses at a certain rate at the surface. Therefore, current well test procedures are not ideal for some wells because the maximum flow rate of production fluids during well testing might not be sufficient to wash out the completion fluids, sand and other debris from the well. Other limitations in the prior art are also present in current well test procedures.

SUMMARY

The present disclosure relates to apparatus and methods for testing, sampling and/or recovering fluids from a well including one or more of, in various combinations, a flow measurement device, a pressure sensor, a temperature sensor, a sampling device and chamber, a solids or particle separator, filter or knockout device, a conduit or other access to the surface, a data storage module, a physical interface for various components, and wherein the apparatus and methods are locatable and operable completely subsea.

According to the present disclosure there is provided a method of flowing fluids from a well having a production flowline, the method comprising flowing the fluids from the production flowline, separating particles from the fluid, flowing the fluid to a sampling device, sampling the fluid in the sampling device, and returning the fluids to the production flowline. In some embodiments, the method is carried out as part of a well test procedure before primary recovery of reservoir fluids commences. The separation of particles from the fluid may be carried out using a particle separator. Particles may also be separated by sampling of the fluid on a continuous or intermittent basis.

The disclosure also provides a well test apparatus or system for conducting well test operations on an oil, gas or water well having a production flowline, the well test system having a testing device in or communicating with a conduit coupled into the production flowline. The conduit guides the fluids from the production flowline to the testing device, and from the testing device back into the production flowline. The testing device may include a sampling device. The testing device may include a particle separator. The particle separator, if present, is typically upstream from the sampling device.

In some embodiments, the well test system includes a particle detector typically located upstream in the conduit from the particle separator, and configured to detect particles in the fluids flowing from the production flowline to the particle separator. In some embodiments, the particle detector includes an acoustic transducer such as a vibration sensor, a piezoelectric transducer or some other design of particle detector. In some embodiments, the particle detector can be an optical sensor, which can optionally be configured to detect the particles by light scattering.

In some embodiments, the particle detector is configured to report the presence of particles in the fluids to a controller such as a data storage module, which can optionally transmit a signal to other components of the well test system or testing device, such as the particle separator. The controller or data storage module may control other components such that, for example, when particles are detected in the conduit the particle detector sends a signal to the controller which in turn initiates appropriate action in the downstream particle separator to remove the particles from the fluids as they pass through the particle separator.

In some embodiments, the particle detector can detect and report quantitative and/or qualitative aspects of the particles such as, for example, particle density, concentration, and particle size. In some embodiments, the data reported from the detector can be used to signal the separator to increase speed, decrease speed, start and stop, or other similar actions.

In some embodiments, the testing device includes a measurement device such as, for example, a flow meter, or alternatively a multiphase flow meter. In some embodiments, the fluids are measured in the measurement device before being sampled. The flow meter is coupled into the conduit between the production flowline and the sampling device. The measurement device may be upstream from the particle separator, but in some embodiments components of the measurement device can be disposed in discrete locations in the conduit to detect characteristics of the fluids at different points in the conduit, including (optionally) positions that are upstream from the particle separator.

In some embodiments, the well test system includes temperature and/or pressure measurement devices, gauges or sensors to determine the temperature and/or pressure of the production fluids and/or the sampled fluids (or any particular phase of either fluid).

In an embodiment of the disclosure, the sampling device is coupled across a device for creating a pressure differential. The device for creating a pressure differential may be a flow restriction in a valve or the like. The device for creating a pressure differential may be adjustable so that the pressure differential across the device can be increased or decreased. In some embodiments, the device includes a choke device configured to restrict the flow of fluids through the choke device, so that a pressure differential is created across the choke device. In some embodiments, the device includes a venturi device or a similar device for passively generating the pressure differential as a result of fluid flowing through the device.

In an embodiment of the pressure differential device, the sampling device is coupled to an inlet side of the pressure device and to an outlet side of the pressure device, such that the pressure differential generated by the pressure device (for example, by the flow restriction of a valve) is applied across the sampling device also. The pressure differential across the sampling device facilitates the sampling procedure, as it drives the production fluids into the sampling device to flow around the restriction of the valve or other device.

In some embodiments, the sampling device includes a sampling chamber to collect sampled fluids. The sampling chamber (and/or optionally the sampling device as a whole) may be detachable from the well test system or testing device and can be isolated from them. In some embodiments, valves that may be ROV operated enable the isolation of the sampling chamber at a subsea wellhead. In an embodiment, the ROV may remove and/or replace the sampling chamber. The ROV can optionally transport the full sampling chamber containing the sampled fluids to the surface for analysis. In some embodiments, the sampling device (and optionally the sampling chamber) includes temperature, pressure and other gauges or sensors adapted to monitor and optionally record the temperature, pressure and other conditions of the sampled fluids in the chamber so that the same conditions can be recreated at the surface during analysis.

The sampling device may include a bypass loop so that the sampling chamber can be bypassed by fluids in the conduit. This allows flushing of the line to remove hydrocarbons before and after recovery of the sampling chamber. The conduit may have a stab connector upstream of the sampling device to permit flushing operations by an ROV at the subsea location of the system. The flushing stab connector can be isolated by means of ROV operated valves. The sampling device can also optionally be configured to collect a sample using a flow through method.

In some embodiments, the particle separator includes a sand filter adapted to separate sand and other particulate matter suspended in the production fluids, and typically has a container for receiving and containing the separated sand or other particles. The container (or the particle separator as a whole) can be detachable from the system or testing device to be removed and replaced for maintenance and/or emptying of the container. In some embodiments, the particle separator is a static helical separator that guides the fluids in a helical path to generate centrifugal forces in the fluid that tend to separate the solids from the liquids. In other embodiments, a rotary centrifugal separator is used. In still other embodiments, a strainer type separator is used. The particular configuration and type of separator employed will depend upon such factors as the process conditions, the material to be separated from the fluid, the amount of particles to be removed, and the upper limit on the particle content of the downstream fluid.

The embodiments discussed above are deployed and operated at a subsea wellhead, though the principles of the disclosure may also be applied to topside or surface wells.

In some embodiments, the conduit passes through or includes a choke body in the wellhead, such as in the christmas tree at the wellhead. The choke body may be located in a branch of the tree, such as in a lateral branch of the tree, or a production or an annulus wing branch connected to a production bore or an annulus bore respectively. In one embodiment, the choke body may be the production choke body. As used herein, "choke body" means the housing which remains after a choke has been removed from the housing. The choke may be a choke of a tree, or a choke of any other kind of manifold. In some embodiments, the conduit is formed by dividing the central conduit of the choke body using a fluid diverter assembly as described in published application WO/2005/047646, which is incorporated herein by reference. The diverter assembly may be located in a branch of the tree in series with a choke. For example, the diverter assembly may be located between the choke and the production wing valve or between the choke and the branch outlet. Further alternative embodiments include a diverter assembly located in pipework coupled to the tree, allowing the diverter assembly to be used in addition to a choke, instead of replacing the choke. Passing the conduit through a branch of a tree means that the tree cap does not have to be removed to fit the conduit. Embodiments of the disclosure can therefore be easily retro-fitted to existing trees.

Embodiments of the disclosure provide that fluids can be diverted from their usual path between the well bore and the outlet of the wing branch. The fluids may be produced fluids being recovered and travelling from the well bore to the outlet of a tree. Alternatively, the fluids may be injection fluids travelling in the reverse direction into the well bore. As the choke is standard equipment, there are well known and safe techniques of removing and replacing the choke as it wears out. The same tried and tested techniques can be used to remove the choke from the choke body and to clamp the diverter assembly onto the choke body, without the risk of leaking well fluids into the ocean. This enables new pipe work to be connected to the choke body and hence enables safe re-routing of the produced fluids, without having to undertake the considerable risk of disconnecting and reconnecting any of the existing pipes (e.g., the outlet header).

In some embodiments, the diverter assembly provides a barrier to separate an outlet from an inlet. The barrier may separate a branch outlet from a production bore of a tree. In some embodiments, the barrier includes a plug, which may be located inside the choke body (or other part of the manifold branch) to block the branch outlet. Optionally, the plug is attached to the housing by a stem which extends axially through the internal passage of the housing. In some embodiments, the diverter assembly provides for diverting fluids from a first portion of a first flowpath to a second flowpath, and for diverting the fluids from a second flowpath to a second portion of the first flowpath. In an embodiment, at least a part of the first flowpath comprises a branch of the tree.

In an embodiment, the testing device is landed on a well tree, for example the christmas tree, and optionally has stab or other connectors to connect into ports on the tree adapted to make up the conduit. The conduit may connect into a fluid diverter assembly located in the body of the production choke of the tree, which can be divided into two (or more) separate portions as described in the published application WO/2005/047646 (e.g., into a bore and annulus). The conduit therefore connects into existing conduits in the tree for export of production fluids from the well and delivery into the production flowline.

In one embodiment, hydraulic control lines, production fluid export conduits and/or electrical connectors can connect to jumpers or other types of connector between the testing device and the tree, enabling the testing device to be controlled or configured by existing tree control lines from the surface, or locally from ROV interaction with the tree.

In one embodiment, the data storage module of the testing device may couple to control modules on the tree.

In one embodiment, the device for creating a pressure differential includes a choke valve connected in series in the conduit between the sampling device and the production flowline inlet.

In one embodiment, the testing device (or the tree) incorporates motion dampers to absorb kinetic energy in the testing device as it lands on the tree. In further embodiments, the testing device or the tree incorporate guide members to guide the testing device onto the tree in a particular configuration so that the appropriate connectors are made up during the landing process.

In embodiments of the disclosure, the production fluids are returned to the production fluids outlet of the tree for export from the well by the normal mechanism of the production fluid flowline. Thus, recovering fluids to the surface or topside facilities for testing and sampling can be avoided. However, in some embodiments of the disclosure, some or all of the fluids can be diverted from the production fluid flowline and recovered from the conduit before sampling with the testing device at the wellhead, and diverted to the surface to a sampling circuit on a rig or a ship, after which they can optionally be flared off, recovered, or returned to the production fluid outlet at the wellhead, typically downstream of the device for creating a pressure differential. For this purpose, the well test system or testing device may incorporate a surface bypass line connecting to a tapping point on the conduit, typically located between the measuring device and the sampling device (which may be removed by an ROV during the export process), thereby creating a bypass loop for the fluids from the measuring device to the surface sampling device and back into the testing device between, for example, the choke device and the inlet to the production fluids flowline.

In some embodiments the surface bypass line can be used to inject fluids into the production flowline into the conduit upstream of the testing or sampling device.

Typically, the method is for recovering fluids from a well, and includes the final step of diverting fluids to an outlet of the production fluid flowline for recovery therefrom. Alternatively or additionally, the method is for injecting fluids into a well. Further, the fluids may be passed in either direction through the conduit.

In certain embodiments, the diverter assembly includes a separator to provide two separate regions within the diverter assembly, and the method may include the step of passing fluids through one or both of these regions. Optionally, fluids are passed through the first and the second regions in the same direction. Alternatively, fluids are passed through the first and the second regions in opposite directions. Optionally, the fluids are passed through one of the first and second regions and subsequently at least a proportion of these fluids are then passed through the other of the first and the second regions. Optionally, the method includes the step of processing the fluids in a processing apparatus before passing the fluids back to the conduit. The diverter assembly may block a passage in the tree between a bore of the tree and its respective outlet.

Certain embodiments provide the advantage that fluids can be diverted (e.g., recovered or injected into the well, or even diverted from another route, bypassing the well completely) without having to remove and replace any pipes already attached to the manifold branch outlet (e.g., a production wing branch outlet).

BRIEF DESCRIPTION OF THE DRAWINGS

Embodiments of the disclosure will now be described by way of example only and with reference to the accompanying drawings in which.

DETAILED DESCRIPTION

Figure 1:
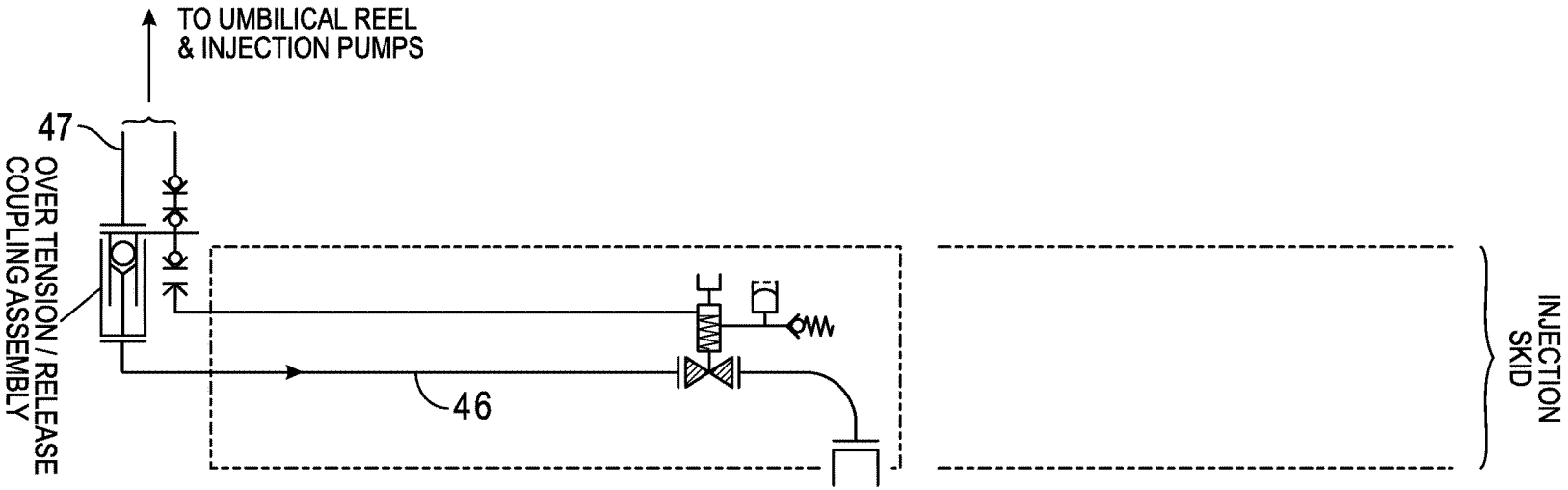
FIG. 1 is a diagrammatic view of a typical production tree with a well test system and a testing device.
Figure 1:
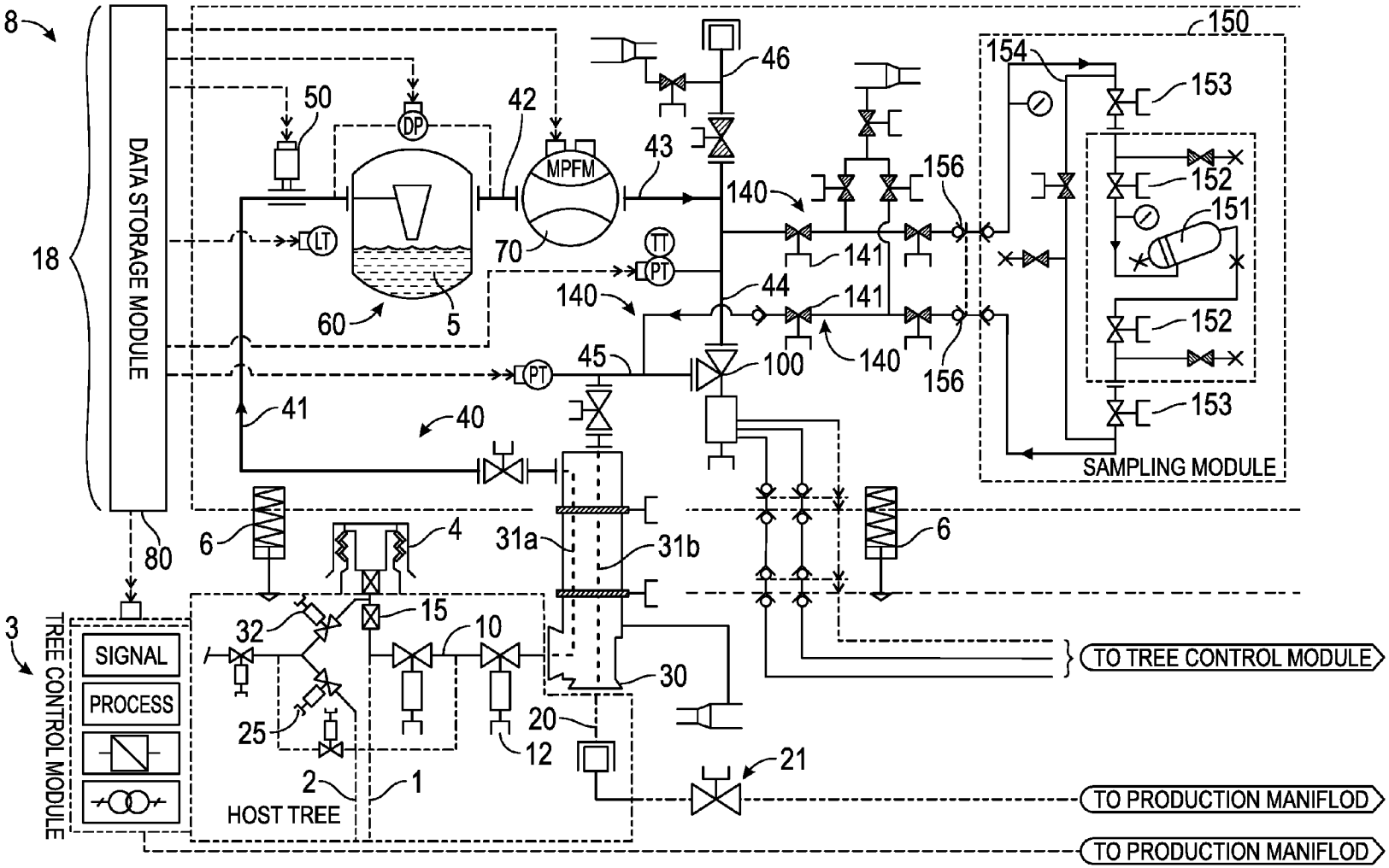

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an inclusive fashion, and thus should be interpreted to mean "including, but not limited to . . . ". Unless otherwise specified, any use of any form of the terms "connect," "engage," "couple," "attach," or any other term describing an interaction between elements is not meant to limit the interaction to direct interaction between the elements and may also include indirect interaction between the elements described. Reference to up or down will be made for purposes of description with "up," "upper," "upwardly," or "downstream" meaning toward the surface of the well and with "down," "lower," "downwardly," or "upstream" meaning toward the terminal end of the well, regardless of the wellbore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Referring now to the drawings, FIG. 1 illustrates a well test system 8 including a testing device 8. A typical production tree on an offshore oil or gas wellhead comprises a christmas tree with a production bore 1 leading from production tubing (not shown) and adapted to carry production fluids from a perforated region of the production casing in a reservoir (not shown). An annulus bore 2 leads to the annulus between the casing and the production tubing and a cap 4. In some embodiments, the cap 4 is not pressure-sealing, such as for a horizontal or spool tree. In other embodiments, the cap 4 is a christmas tree cap such as for a vertical tree, which seals off the production and annulus bores 1, 2, and provides a number of hydraulic and electrical control and signal lines, or tree cap control module 3 by which a remote platform or intervention vessel can communicate with and operate the valves in the christmas tree. The cap 4 is removable from the christmas tree in order to expose the production and annulus bores in the event that intervention is required and tools need to be inserted into the production or annulus bores 1, 2.

The flow of fluids through the production and annulus bores is governed by various valves shown in the tree of FIG. 1. The production bore 1 has a branch 10 which is closed by a production wing valve (PWV) 12. A production wireline plug (PWP) 15, as is found in a horizontal or spool tree, closes the production bore 1 above the branch 10 and PWV 12. In alternative embodiments, the tree is a vertical tree and the component 15 is a production swab valve. Two lower valves typically close the production bore 1 below the branch 10 and PWV 12. The annulus bore is closed by an annulus master valve (AMV) 25. An annulus swab valve 32 closes the upper end of the annulus bore 2. The valves in the tree are generally hydraulically controlled by hydraulic control channels passing through the tree cap control module 3, in response to signals generated from the surface or from an intervention vessel.

When production fluids are to be recovered from the production bore 1, PWP 15 is closed, and PWV 12 is opened to open the branch 10 which leads to a production flowline 20. Production flowline 20 is generally connected to the branch 10 by a choke and has a production flowline valve (PFV) 21 to close off the bore of the flowline 20. In the FIG. 1 arrangement, the conventional tree choke has been removed, and a modified production choke body (PCB) 30 has been connected between the branch 10 and the flowline 20.

The modified production choke body 30 typically comprises a fluid diverter as disclosed in published application WO2005/047646. The fluid diverter can optionally be incorporated into a modified choke body 30 that connects into the inlet and outlet of the existing choke, or the existing choke body can be used with a separate fluid diverter installed within it. The fluid diverter has two separate flowpaths 31*a* and 31*b*. The flowpaths can be created in a variety of different ways; for example, they can be formed as bore and annulus between concentric tubes, or the central bore of the choke body 30 can be divided by a plate that separates the inlet from the outlet.

The first flowpath 31*a* flows from an inlet connected into the branch 10 and connects the branch 10 to a first section 41 of a conduit 40. The first section 41 of the conduit 40 may include a 5" pipe with an ROV operable valve. The first conduit section 41 extends between the choke body 30 and a particle separator 60. In one embodiment, the particle separator 60 includes a sand knockout vessel (SKV). Between the choke body 30 and the sand knockout vessel 60 the conduit section 41, in some embodiments, may include a particle detector 50 disposed adjacent or mounted on its outer surface to detect the presence and, optionally, the characteristics of any particles passing through the conduit section 41. The particle detector 50 may include an acoustic transducer, which is configured to detect vibrations in the conduit section 41 resulting from particles of sand and the like as they pass the transducer 50. Alternative embodiments of the particular separator include components as already described above. The transducer 50 may include a signal line that reports the data collected by the transducer 50 to a data storage module 80.

Downstream of the transducer 50 the sand knockout vessel 60 separates the sand S or other particulates from the fluids and dumps the sand S into the bottom of the vessel for later recovery. The sand knockout vessel 60 may have pressure, temperature and other sensors that report the conditions (and possibly quantities) of the materials in the vessel 60 and the pressure drop across it to the data storage module 80. In some embodiments, the action of the sand knockout vessel 60 is passive. In other embodiments, the action of the SKV 60 is controlled by signals from the data storage module 80, which can be automatic, in response to the data collected from the transducer 50, timed, or manually activated from the surface ship or rig.

Downstream of the sand knockout vessel 60 is a flow measurement device 70. The flow measurement device 70, in some embodiments, is a multiphase flow meter (MPFM). The MPFM 70 is connected to the SKV 60 by a second section 42 of conduit 40. The MPFM 70 measures the flow rate of each of the phases of the fluids passing through the conduit section 42, and this data is optionally reported to and stored in the data storage module 80. The data storage module 80 may be retrieved and the data analyzed. Such an arrangement avoids the need to provide a direct communications link to the surface. The data storage module 80 may also serve to back up data for the system 8 and/or the testing device 18.

A conduit 43 leading from MPFM 70 connects to a sampling conduit 44 leading to a choke valve 100. The sampling conduit 44 includes a branch comprising a sampling circuit 140 connecting the sampling conduit 44 to a sampling device or module 150. The sampling circuit 140 can be isolated from the conduit 40 by valves 141. The sampling circuit 140 includes a sampling chamber 151, such as a tank, connected in series in the sampling circuit 140. The tank 151 is isolated by two pairs of ROV operable valves 152 and 153 on respective sides of the tank 151, and when the valves 152 and 153 are closed, the sampling circuit 140 and the tank 151 can be disconnected and the tank removed and replaced by an ROV.

The sampling device 150 may include a bypass flushing loop 154 outside the outer valves 153 for flushing fluids through the sampling device 150 but bypassing the tank 151. A hot stab port HS3 is provided across the sampling circuit 140 for optional injection and recovery of flushing fluids by an ROV. The sampling device 150 may include temperature, pressure, and other gauges, or combinations thereof, that measure the characteristics of the fluids passing through and/or collected in the tank 151, or passing through the sampling circuit 140. In some embodiments, the collected data can be optionally recorded at the data storage module 80 and transmitted to surface, or collected by the ROV.

In some embodiments, the entire sampling device 150 can be disconnected from the conduit 40 by hydraulic connectors 156. In one embodiment, the conduit 40 and the sampling device 150 can be connected on a skid incorporating the production choke body 30 and the skid can optionally be landed as a unit on top of the tree using soft landing dampers 6.

In some embodiments, the location of the sampling circuit 140 on the wellhead results in samples that are not affected by pressure and temperature changes resulting from transport of the sample to surface or topside sampling devices before collection of the sample. Furthermore, the subsea location of the sampling circuit 140 enables flow meter calibration (affected by water cut/salinity), tracer detection (understanding the reservoir), understanding the need for scale squeeze (Barium content), and understanding well fluid composition.

The sampling circuit 140 returns the fluids back to the conduit 40 downstream of the sampling conduit 44, in a return conduit 45 that returns fluids back to the production choke body 30. Between the sampling conduit 44 and the return conduit 45 is the choke 100, which serves as one form of device configured to create a pressure differential across the sampling circuit 140. The choke 100 may be variable and can be opened or closed to vary the pressure differential applied by the choke 100 across the sampling circuit 140. For example, the choke 100 can choke the flow of fluids flowing directly from conduit 44 into conduit 45, and force more of the fluids through the sampling circuit 140 than can pass through the choke 100. The choke 100 is optionally ROV controllable and can also be connected via hydraulic or electrical connectors through the tree to choke control lines already in place in the tree architecture.

Figure 2:
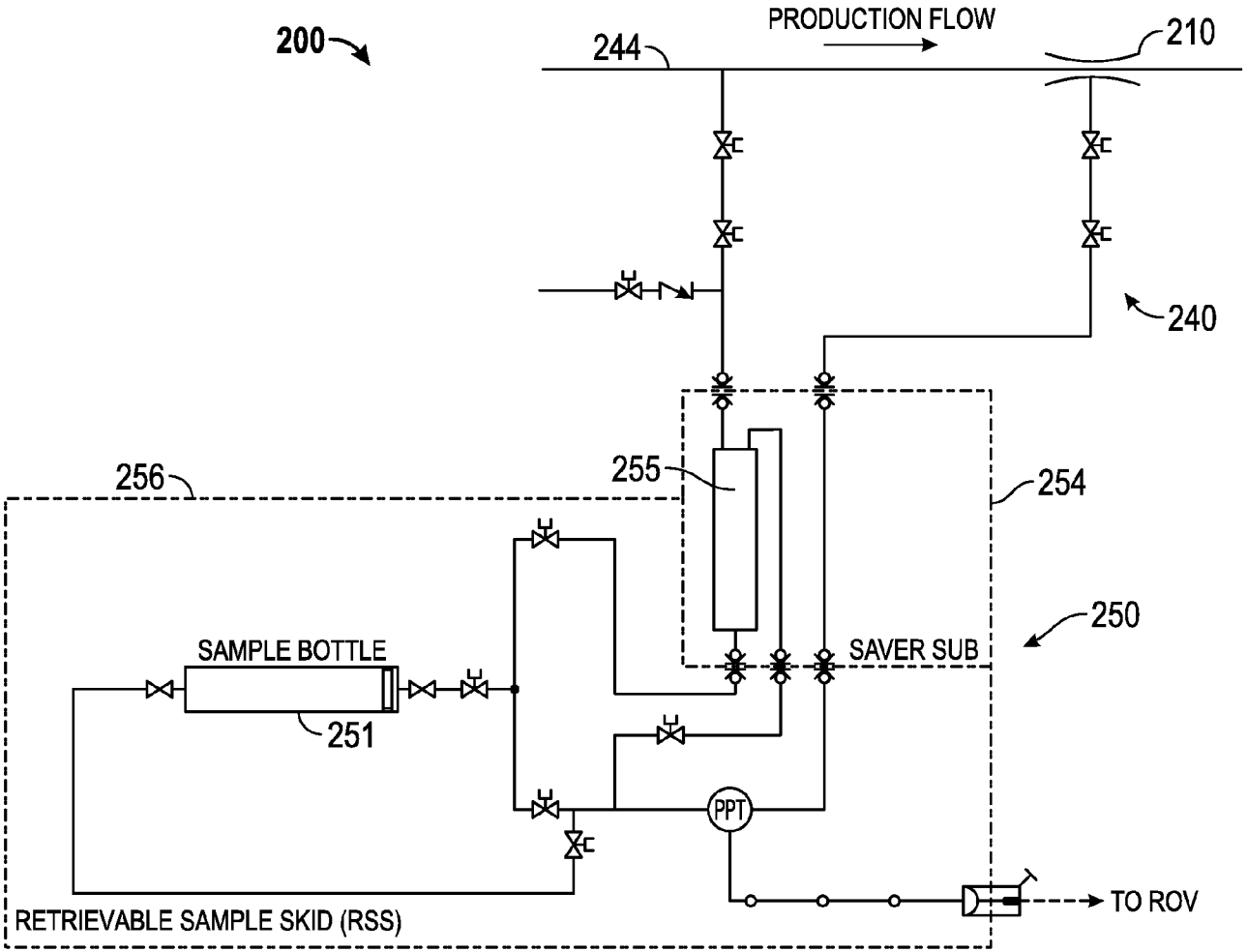
FIG. 2 is a diagrammatic view of a portion of an alternative testing device using a pressure differential venturi.
Figure 3:
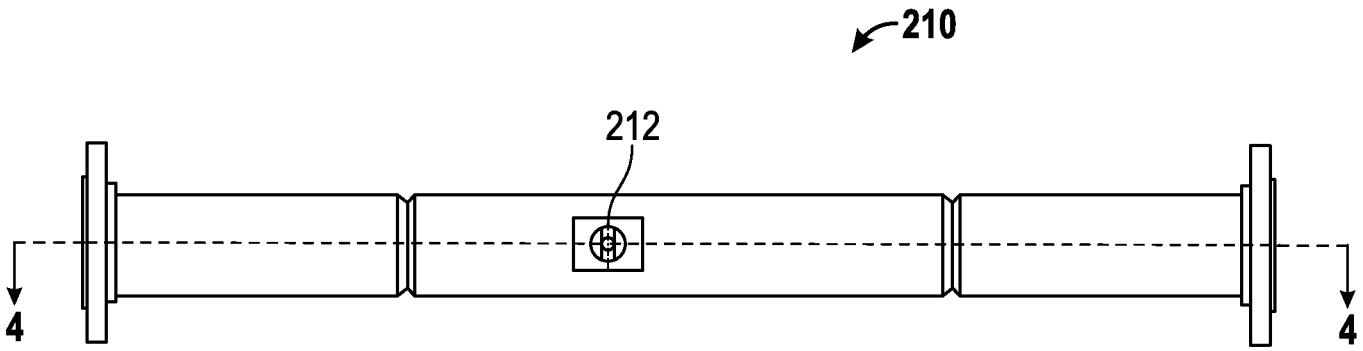
FIG. 3 is a top plan view of the pressure differential venturi of FIG. 2.
Figure 4:
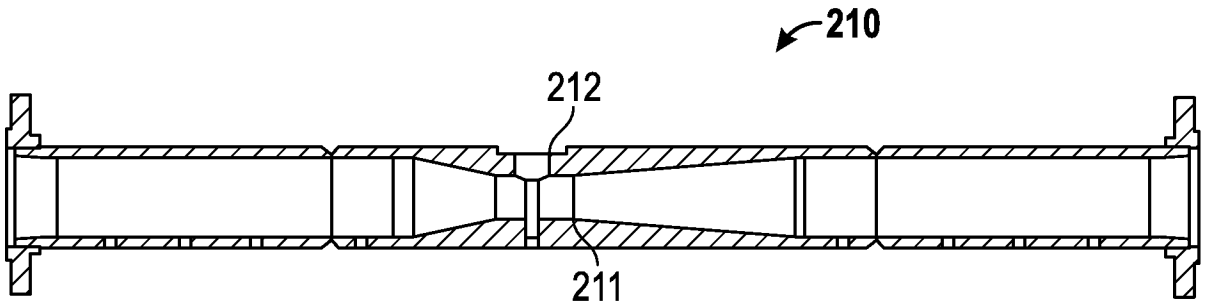
FIG. 4 is a cross-section view of the pressure differential venturi of FIGS. 2 and 3.

In other embodiments, other devices may be used as the pressure differential device. Referring now to FIG. 2, an alternative subsystem 200 includes a venturi component, and is replaceable with the corresponding subsystem of the system 8 and testing device 18 as will be described. The subsystem 200 includes a sampling circuit 240 connectable into a conduit 244, similar to the way the sampling circuit 140 connects into the conduit 44. The subsystem 200 also includes a sampling device 250 replacing the sampling device 150. The sampling device 250 includes a saver sub 254 having a three port bottle 255 coupled into the sampling circuit 240. The sampling device 250 includes a sample skid 256 having a piston sample bottle 251 connected as shown. In some embodiments, the sample skid 256 is retrievable. Instead of the pressure differential device 100, the subsystem 200 includes a venturi type component 210. As shown in FIGS. 3 and 4, the venturi component includes a port 212 and a inner restricted diameter 211.

Figure 5:
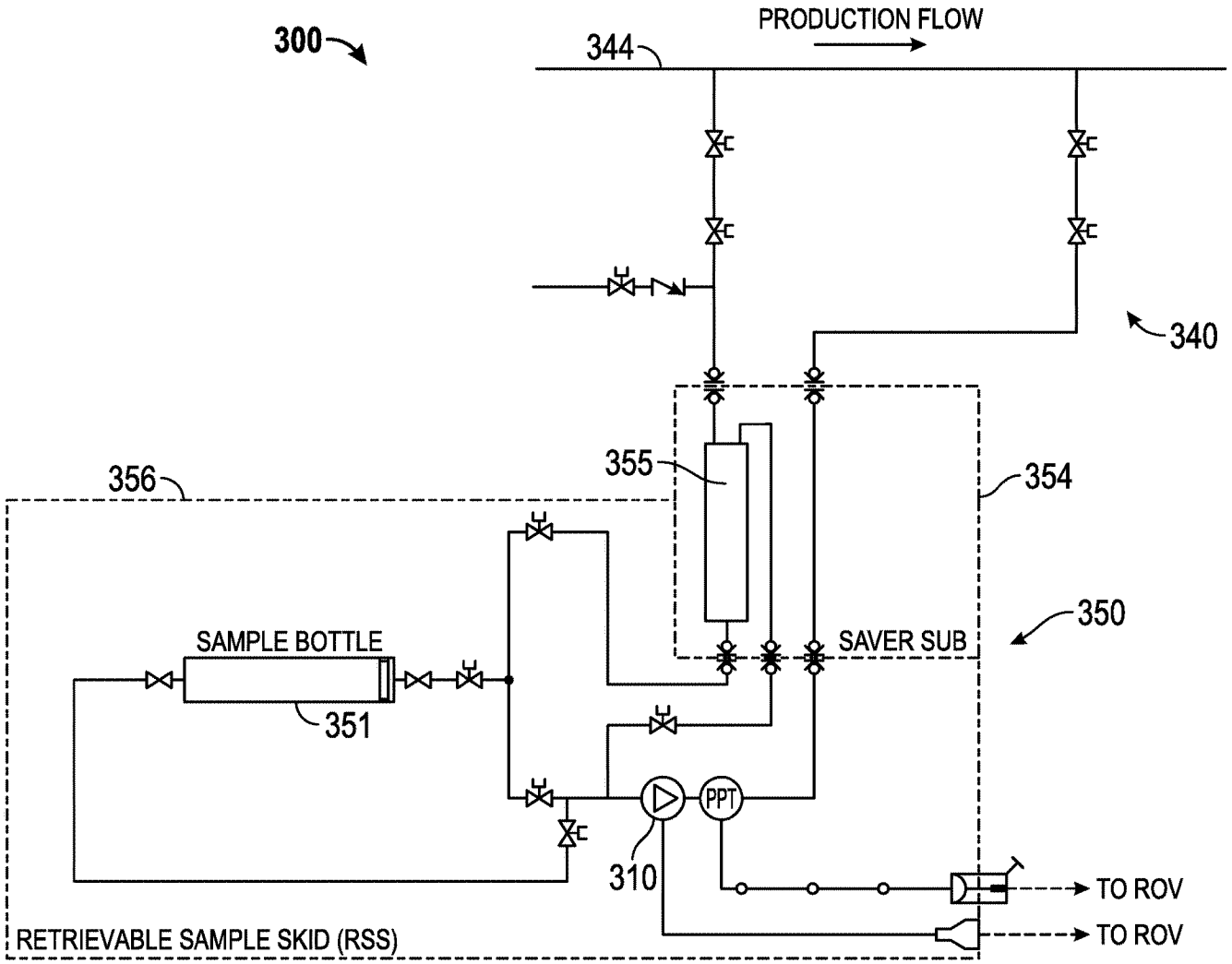
FIG. 5 is a diagrammatic view of a portion of another alternative testing device using a positive displacement pump.
Figure 6:
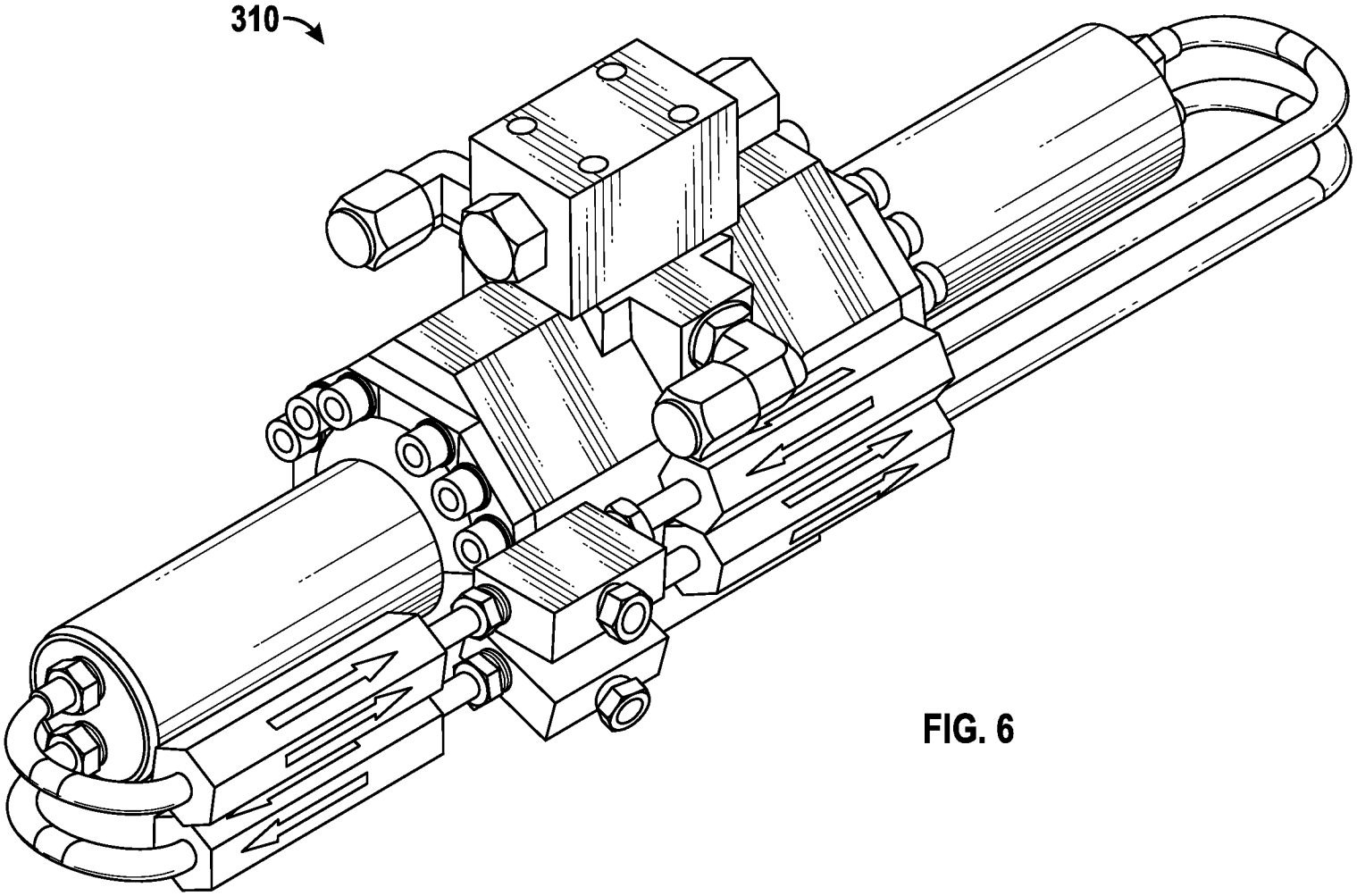
FIG. 6 is a perspective view of the positive displacement pump of FIG. 5.

In applications where there is insufficient drive or fluid pressure differential available, an alternative embodiment may include a pump. Referring now to FIG. 5, an alternative subsystem 300 includes a pump, and is replaceable with the corresponding subsystem of the system 8 and testing device 18 as will be described. The subsystem 300 includes a sampling circuit 340 connectable into a conduit 344, similar to the way the sampling circuit 140 connects into the conduit 44. The subsystem 300 also includes a sampling device 350 replacing the sampling device 150. The sampling device 350 includes a saver sub 354 having a three port bottle 355 coupled into the sampling circuit 340. The sampling device 350 includes a sample skid 356 having a piston sample bottle 351 connected as shown. In some embodiments, the sample skid 356 is retrievable. Instead of the pressure differential device 100 or the pressure differential venturi 210, the subsystem 300 includes a pump component 310. The pump 310 is shown in more detail in FIG. 6.

Referring back to FIG. 1, the return conduit 45 returns the fluids from the sampling circuit 140 and/or the sampling conduit 44 back to the second flowpath **31*b* of the choke body PCB 30, which delivers the fluids to the production flowline 20 for normal recovery through the existing well connections. Consequently, the testing device 18** provides a subsea testing and/or sampling bypass flowpath or loop for the production fluids to be routed through. The fluids travel through a circulation loop that is completely disposed subsea.

Figure 7:
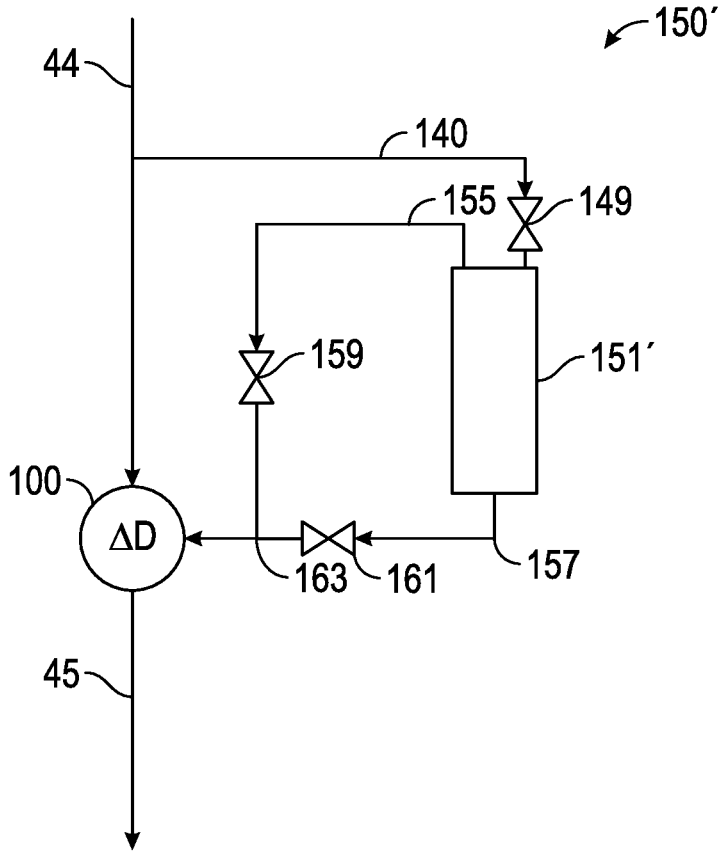
FIG. 7 is a diagrammatic view of an alternative fluid sampling device configuration for the well testing device.

The embodiments described above include sampling devices 150, 250, 350 using a flow through method to receive and possibly collect a fluid sample. Referring now to FIG. 7, the flow through method of receiving and/or taking a sample involves diverting some of the production flow through a tank 151' and returning the fluid back downstream with a sampling device 150'. As shown, the fluid sampling circuit 140 connects the sampling conduit 44 to a sampling chamber in the form of a tank 151'. Fluid flows into the tank 151' though an inlet line with an inlet valve 149 and out of the tank 151' though one of two outlet lines, 155 and 157, each with corresponding valves 159 and 161. Although initially separate, the outlet line 155 connects with the outlet line 157 at 163 before connection with the conduit 45.

In some embodiments, well testing operations using the embodiments of the well test systems and testing devices herein may be conducted as follows. Fluids from the production bore 1 are routed by the fluid diverter in the PCB 30 into the conduit 40. The fluids are de-sanded by the sand knockout vessel 60 and the flow rates and phase composition of the fluids are measured by the MPFM 70 before being delivered into the sampling circuit 140 via the sampling conduit 44. The sampling circuit 140 passes the fluids through the tank 151 and when a representative sample of fluids has been collected in the tank 151, the tank is isolated from the fluid conduit 44 by closing the valves 152 and 153, and the tank 151 is then disconnected from the sampling device 150 and recovered to the surface by ROV for analysis of the fluids collected in the tank 151. The choke 100 can be adjusted during the sampling procedure to maintain a pressure differential across the sampling device 150 during the collection of the sample to drive the sample of the fluids into the tank 151. For example, if the pressure differential across the sampling circuit 140 is too low and fluids are not being driven into the tank, the choke 100 can be closed slightly to increase the pressure differential across the sampling circuit 140 and drive more fluids into the tank 151. If the pressure differential is too high across the sampling circuit 140, which may lead to an artificially high proportion of gasses being forced ahead of the liquids into the tank 151, then the choke 100 can be opened to decrease the pressure differential and avoid a misrepresentative sample from being collected in the tank.

By controlling the choke 100 during the sampling procedure, the pressure differential can be kept constant with changing wellbore pressure, thereby facilitating the collection of a more consistent sample in the tank 151. The alternative pressure differential components 210, 310 may be used in a similar manner.

In one modified embodiment, the sampling conduit 44 can have an auxiliary line 46 connected to a riser 47 leading to the surface for treatment of the fluids. Optionally, the sampling circuit 140 is isolated by closing valves 141, and the fluids are diverted from the sampling conduit 44 to the auxiliary line 46 through appropriate one way valves (and optionally pumps) to the surface for collection of the sample if desired.

In some embodiments, the fluids routed to surface can be returned to the wellhead through an auxiliary return line (not shown) that connects into the conduit 40 between the choke 100 and the production choke body 30 in the same way as is described for the sampling circuit 140, so that the choke 100 can be used to control the pressure differential applied across the auxiliary line 46.

When sampling with the embodiment shown in FIG. 7, the sampling device 150' is initially closed by closing the valves 149, 159, and 161. The tank 151' may initially contain an inhibitor, such as monoethylene glycol (MEG). The tank 151' is then purged by opening valve 161 and displacing the inhibitor out of the outlet line 157. Once purge is complete, the outlet valve 161 is closed and the inlet of the tank 151' can be opened by opening the inlet valve 149, allowing fluid to enter the tank 151'. The outlet valve 159 on the outlet line 155 is then opened such that fluid circulates through the tank 151' until equilibrium is reached. This allows the pipework to heat up and a thermal equilibrium to be reached. Once the tank 151' is full and equilibrium reached, the outlet valve 159 is closed and production fluid circulates in the tank 151' for a period of time, producing a representative fluid sample.

The tank 151' can then be isolated by closing inlet valve 149 and can be recovered to the surface for analysis as discussed above. The sample is taken at flowing pressure and can be isobarically decanted and heated in a laboratory. The flowing temperature and pressure at the time of the sample can also be recorded from the host equipment instrumentation or from the sampling package.

As the sample is driven by the production flow, the well continues to produce while testing and/or sampling so there are no deferred production costs associated with the test or sample capture.

Returning the produced fluid downstream means that both production and any flushing fluids are kept within the production system, thus negating the need for slops tanks and reducing health, safety and environment risks. As the testing and sampling loop becomes an extension of the host production system, the sampling dynamics become independent of hydrostatic pressure, thus assisting with sub-hydrostatic wells.

In one embodiment, a portion of the fluids can be flared off at the surface without being returned to the wellhead.

In one embodiment, the auxiliary line 46 can be used for injection of fluids into the well, for pressure control, or from another well. The injection of fluids may be used by the appropriate selection of the fluid being injected, for example, to moderate or kill the well, provide scale treatment, inhibit hydration or corrosion, or for fluid disposal.

Modifications and improvements may be incorporated without departing from the scope of the disclosure. For example, the diverter assembly could be attached to an annulus choke body, instead of to a production choke body.

All of the apparatus shown and described can be used for both recovery of fluids and injection of fluids by reversing the flow direction.

What is claimed is:

1. A well testing device for conducting well test operations on an oil, gas, or water well including a production flowline, the device comprising:

a conduit connectable into the production flowline to circulate fluids from the production flowline and back into the flowline; and a testing device coupled into the conduit to receive the circulated fluids, the testing device comprising a sampling device and a pressure differential device configured to create a pressure differential to control the flow of fluids to the sampling device;

wherein the pressure differential device is a venturi or a pump;

wherein a particle separator is upstream of the sampling device and wherein the conduit guides fluids to the particle separator before the sampling device.

2. The well testing device of claim 1, wherein the conduit forms a circulation loop for the fluids disposed completely subsea.

3. The well testing device of claim 1, wherein the sampling device comprises a sampling chamber to collect sampled fluids from the production flowline.

4. The well testing device of claim 3, wherein the sampling chamber can be isolated from the testing device and is detachable from the testing device.

5. The well testing device of claim 3, further comprising a bypass loop to bypass fluids around the sampling chamber.

6. The well testing device of claim 1, further comprising a particle detector located upstream of the particle separator, the particle detector configured to detect particles in the fluids flowing from the production flowline to the particle separator.

7. The well testing device of claim 6, further comprising:

a data storage module;

wherein the particle detector is configured to report particle data in the fluids to the data storage module; and wherein the data storage module is configured to control the particle separator based on the particle data from the particle detector.

8. The well testing device of claim 1, wherein a flow measurement device is upstream of the sampling device to measure a characteristic of the fluids from the production flowline.

9. The well testing device of claim 1, wherein the pressure differential device is disposed between the conduit and the production flowline to control the flow of the fluids into the sampling device.

10. The well testing device of claim 1, wherein the sampling device further comprises:

a sampling chamber comprising a tank;

an inlet line to guide fluids from the conduit to the tank;

a first outlet line to guide fluids from the tank back to the conduit;

a second outlet line to guide fluids from the tank to the first outlet line downstream of the tank;

valves for controlling flow in each of the inlet line and the first and second outlet lines; and wherein the valves can be controlled to collect a sample of the fluids flowing from the production flowline in the tank as well as isolate the tank from the well test system.

11. The well testing device of claim 1, wherein the fluid diverter assembly located in the body of a choke in a branch of a subsea tree, the diverter assembly configured to divert production fluids from the tree branch to the well testing device.

12. A method of testing fluids flowing between a well and a production flowline, the method comprising:

flowing the fluids from the production flowline into a conduit;

flowing the fluids through the conduit to a sampling device comprising a sampling chamber;

creating a pressure differential using a venturi or a pump to control the flow of fluids to the sampling device;

returning the fluids to the production flowline; and detecting particles in the fluids flowing from the production flowline prior to separating the particles from the fluids.

13. The method of claim 12, wherein flowing the fluids from the production flowline into the conduit and returning the fluids to the production flowline occur subsea.

14. The method of claim 12, further comprising any one or more of:

measuring a characteristic of the fluids in the conduit;

separating particles from the fluids in the conduit; and sampling the fluids in the sampling device using the sampling chamber.

15. The method of claim 14, wherein any one or more of the measuring, separating, flowing to the sample device, creating a pressure differential, or sampling the fluids is part of a well test procedure before primary recovery of reservoir fluids commences.

16. The method of claim 12, further comprising:

detecting particle data in the fluids;

reporting the particle data to a data storage module; and controlling the particle separation based on the particle data.

17. The method of claim 12, further comprising isolating the sampling chamber from the fluid flow and detaching the sampling chamber from the conduit.

18. The method of claim 12, further comprising bypassing fluids around the sampling chamber.

19. The method of claim 12, wherein sampling fluids in the sampling device further comprises:

purging the sample chamber by opening a first outlet from the sample chamber;

closing the first outlet;

flowing fluids into the sample chamber by opening an inlet to the sample chamber;

opening a second outlet from the sample chamber and circulating fluids through the tank until equilibrium is reached;

closing the second outlet and collecting fluids in the sample chamber; and isolating the sample chamber by closing the inlet and first and second outlets.

20. The method of claim 12, further comprising:

connecting the conduit into a subsea tree; and wherein flowing the fluids from the production flowline further comprises diverting fluids from a body of a choke in a branch of the subsea tree.

* * * * *